United States Patent [19]

Matsumoto et al.

[11] Patent Number: 5,068,133

[45] Date of Patent: Nov. 26, 1991

[54] PROCESS FOR PRODUCING HEAT-SENSITIVE RECORDING MATERIAL USING ROLL BLADE COATING

[75] Inventors: Hisashi Matsumoto, Kobe; Masaaki Takami, deceased, late of Kakogawa, Japan, by Harumi Takami, successor

[73] Assignee: Mitsubishi Paper Mills, Ltd., Tokyo, Japan

[21] Appl. No.: 261,894

[22] Filed: Oct. 25, 1988

[30] Foreign Application Priority Data

Oct. 27, 1987 [JP] Japan ..... 62-272524

[51] Int. Cl.[5] ..... B05D 3/12

[52] U.S. Cl. ..... 427/358; 427/299; 427/385.5; 427/407.1

[58] Field of Search ..... 427/209, 299, 358, 365, 427/385.5, 407.1; 428/913; 118/126, 410, 414

[56] References Cited

U.S. PATENT DOCUMENTS 4,414,259 11/1983 Tsuchiya et al. ..... 428/913 X
4,613,526 9/1986 Nakamura et al. ..... 427/358 X
4,764,496 8/1988 Narui et al. ..... 428/913 X
4,833,116 5/1989 Yamori et al. ..... 428/913 X

FOREIGN PATENT DOCUMENTS 3019591 12/1980 Fed. Rep. of Germany .

OTHER PUBLICATIONS

Booth; "Coating Equipment and Processes"; Lockwood Publishing Co., Inc.; 1970; pp. 83, 91, 113–115, 452–453.

Pulp and Paper Canada, vol. 76, No. 10/Oct. 1975, pp. 80–84.

Pulp and Paper Chemistry and Chemical Technology, 3rd edition, vol. IV, James P. Casey, 1983, pp. 2152–2154.

*Primary Examiner*—Shrive Beck
*Assistant Examiner*—Alain Bashore
*Attorney, Agent, or Firm*—Cushman, Darby & Cushman

[57] ABSTRACT

A heat-sensitive recording material produced by a process wherein an excess amount of a color developing layer coating solution or a protective layer coating solution is removed by a roll blade coater is excellent in recording machine applicability and dynamic sensitivity without bringing about streaks, pressure fogging and heat fogging on the uppermost treated surface.

12 Claims, 3 Drawing Sheets

PROCESS FOR PRODUCING HEAT-SENSITIVE RECORDING MATERIAL USING ROLL BLADE COATING

BACKGROUND OF THE INVENTION

This invention relates to a process for producing a heat-sensitive recording material having a coating structure excellent in smoothness, uniformity and stability, and also having excellent applicability to recording machines such as a facsimile machine.

A heat-sensitive recording material comprising a support and formed thereon a color developing layer comprising a color former and a color developer which develops a color by the reaction with the color former when heated is not so expensive, so that it is widely used as a recording medium in recording machines such as facsimile machines, printers, which are now compact and easy for maintenance. Recently, with miniaturization and high speed recording of facsimile machines, there is demanded a heat-sensitive recording material which is possible to conduct high speed recording with low energy.

In order to meet such a demand, it is proposed a heat-sensitive recording material comprising a base sheet and formed thereon a color developing layer having a surface roughness of an Ra smaller than 1.2 microns and a gloss smaller than 25% (U.S. Pat. No. 4,414,259). According to this U.S. patent, the color developing layer is formed on the base sheet by the blade coating technique, more concretely by using a bend type (generally called "bent type") blade coater. According to the blade coating method, there is an advantage in that a coating solution with a higher concentration to some extent can be used, but there is an disadvantage in that there are formed so-called streaks (scratching lines) due to high shear strength of a blade of a blade coater. Particularly, when the bent blade coater is used, it is necessary to use a low concentration solution in order to prevent streaks. When the low concentration solution is used, drying load increases and there easily bring about heat fogging and pressure fogging.

As to recording machine applicability, in order to enhance adhesion between a thermal head and a heat-sensitive recording material surface, the surface of the color developing layer is generally subjected to a smoothing treatment using a calender such as a super calender, gloss calender, and the like. But even if the surface of the color developing layer is simply enhanced in smoothness by the treatment using a super calender, or the like, it becomes impossible to obtain satisfactory dynamic sensitivity and further texture fogging and undesirable sticking are produced due to the pressure of calender.

SUMMARY OF THE INVENTION

It is an object of the present invention to provide a process for producing a heat-sensitive recording material overcoming the defects mentioned above, improved in color developing properties and having balanced quality and a uniform and stable coating layer structure excellent in smoothness even if subjected to slight calendering treatment as well as good recording machine applicability.

This invention provides a process for producing a heat-sensitive recording material comprising a support, and formed thereon a color developing layer having a surface roughness Ra of 1.1 μm or less, and a printing smoothness Rp of 7.8 μm or less under a pressure of 5 kg/cm$^2$, which comprises coating a color developing composition solution comprising a color former and a color developer, which forms a color by a reaction with the color former when heated, on a support using an applicator, removing an excess color developing composition solution by a roll blade coating method, drying the resulting support, and if necessary subjecting the dried support to a calender treatment.

This invention also provides a process for producing a heat-sensitive recording material having an undercoating layer comprising one or more pigments, a binder, etc., between the support and the color developing layer.

This invention also provides a process for producing a heat-sensitive recording material comprising a support, formed thereon a color developing layer, and formed thereon a protective layer having a surface roughness Ra of 1.1 μm or less, which comprises forming a color developing layer comprising a color former and a color developer on a support, coating a coating solution for the protective layer on the color developing layer using an applicator, removing the excess coating solution for the protective layer by a roll blade coating method, drying the resulting support, and if necessary subjecting the dried support to a calender treatment.

This heat-sensitive recording material may have an undercoating layer comprising one or more pigments, a binder, etc., between the support and the color developing layer.

Further, these heat-sensitive recording materials may have a back coat layer on an opposite side of the color developing layer on the support.

DESCRIPTION OF THE PREFERRED EMBODIMENTS

Figure 1:
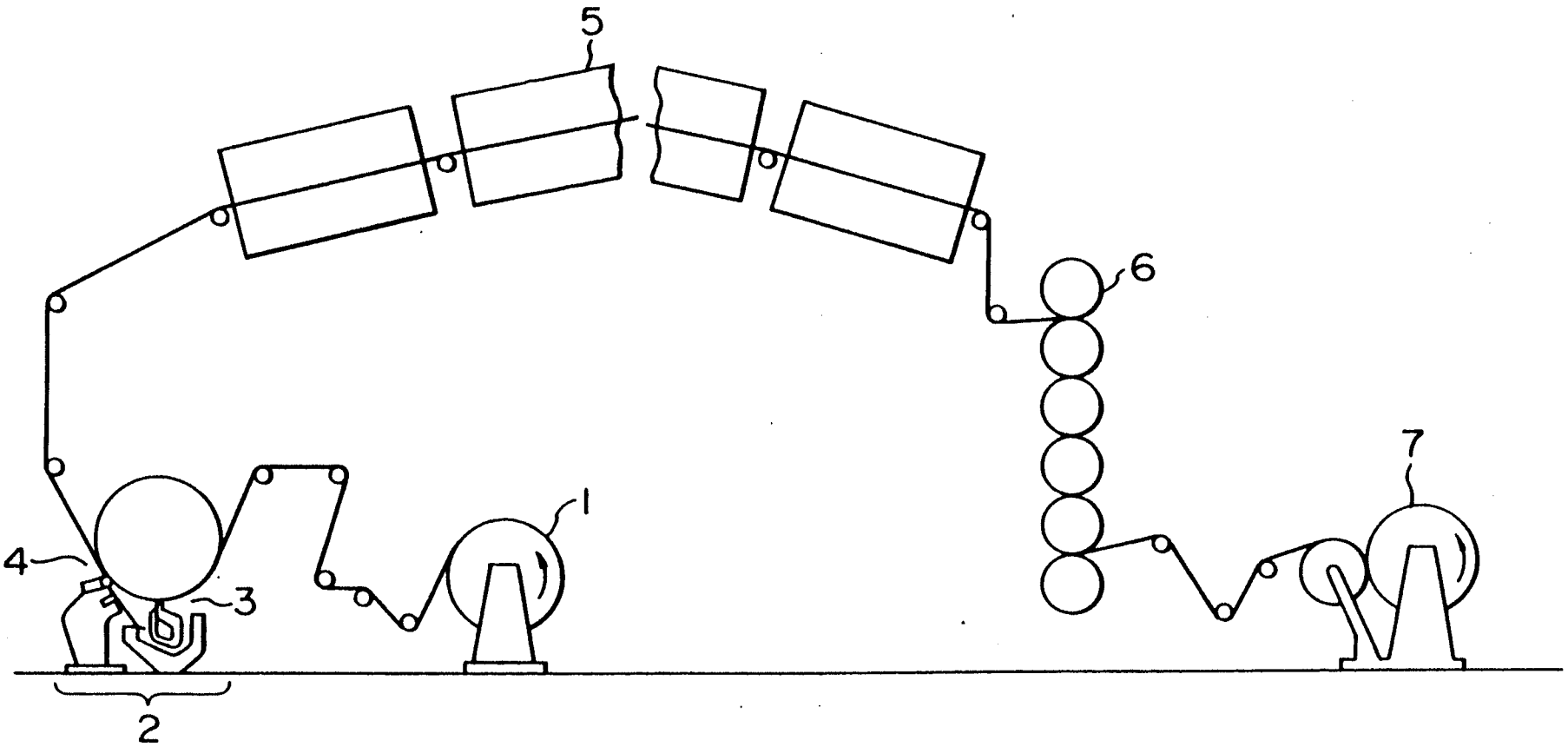
FIG. 1 is a flow sheet showing one example of the process of the present invention.

The surface roughness Ra of the color developing layer and the protective layer formed thereon is measured according to JIS B 0601. The Ra means a central line mean roughness and is defined as follows:

$$Ra = \frac{1}{L}\int_0^L |f(x)|\,dx$$

wherein L is a sample length measured in a direction along the central line of the surface roughness characteristic curve represented by $$y = f(x)$$

In order to make measuring errors smaller, a contact feeler type three-dimensional surface roughness analyzer (SPA-11 type mfd. by Kosaka Laboratory, Ltd.) is used to measure the surface roughness Ra.

When the surface roughness Ra of the color developing layer or the protective layer formed thereon is larger than 1.2 to 1.4 μm, no satisfactory dynamic sensitivity can be obtained, even adjusting the pressure of a platen which presses a heat-sensitive recording material on a thermal head. Therefore, the surface roughness Ra of the color developing layer or the protective layer should be 1.1 μm of less, preferably 0.6 to 0.9 μm.

From the view point of dynamic sensitivity, it seems to be desirable to make the surface roughness Ra of the color developing layer or the protective layer smaller. But the present inventors have found that when the surface roughness Ra is too small, there arise deposition of tailings on a thermal head and the so-called sticking, which results in lowering recording machine applicability and dynamic sensitivity.

Further, it was also found that the printing smoothness Rp of the surface of the color developing layer is an important factor to give balanced high quality in the dynamic sensitivity, the recording machine applicability, and the like in addition to the surface roughness Ra. That is, when the printing smoothness Rp under a surface pressure of 5 kg/cm$^2$ of the color developing layer is larger than 7.8 μm, the quality balance is broken even if the surface roughness Ra is 1.0 μm or less, which results in making it impossible to obtain a heat-sensitive recording material good in both the dynamic sensitivity and recording machine applicability.

Thus, it is necessary to adjust the printing smoothness Rp of the color developing layer to 7.8 μm or less, preferably 4 to 6 μm, under a surface pressure of 5 kg/cm$^2$ in addition to the surface roughness Ra of 1.1 μm or less.

The printing smoothness Rp of the color developing layer can be measured by using a printing smoothness tester (a contact rate measuring optical device, Microphotograph, mfd. by Toyoseiki Seisaku-sho, Ltd.). The Rp gives an amount proportional to an average depth of recesses on a sample surface contact bonded to a standard plane (prism). More in detail, as presented in Japanese Printing Society Articles, vol. 17, No. 3, (1978) and in a 60th Spring Meeting for Reading Research Papers of Japanese Printing Society, the Rp value is obtained as follows.

A ratio of a transmitted light amount to an incident light amount obtained when a wavelength is changed is found, that is, individual values of optical contact ratios [F(λ)] are found, and values of Fo and k are found by the method of least square by inserting into the following approximate exponential function equation:

$$F(\lambda)=Fo+(l-Fo)\cdot(l-e^{-k\lambda}) \quad (1)$$

wherein Fo is a proportion of area of paper physically contacting with the prism; and k is a constant relating to shape distribution of paper. The Rp value is obtained by the following equation:

$$Rp=\{l-F(\lambda)\}d\lambda \quad (2)$$

Then, by inserting the equation (1) into the equation (2), Rp becomes:

$$Rp=(l-Fo)/k$$

Finally, the Rp value can be obtained from the Fo and k values obtained previously.

The color developing layer and the protective layer having such a surface roughness Ra and such a printing smoothness Rp (in the case of the color developing layer) is formed by a roll blade coating method, wherein a high concentration coating solution can be coated on a support or an undercoating layer formed on the support in the case of the color developing layer, or on the color developing layer in the case of the protective film without generating streaks and absorption unevenness of a binder in the coating solution.

Figure 3:
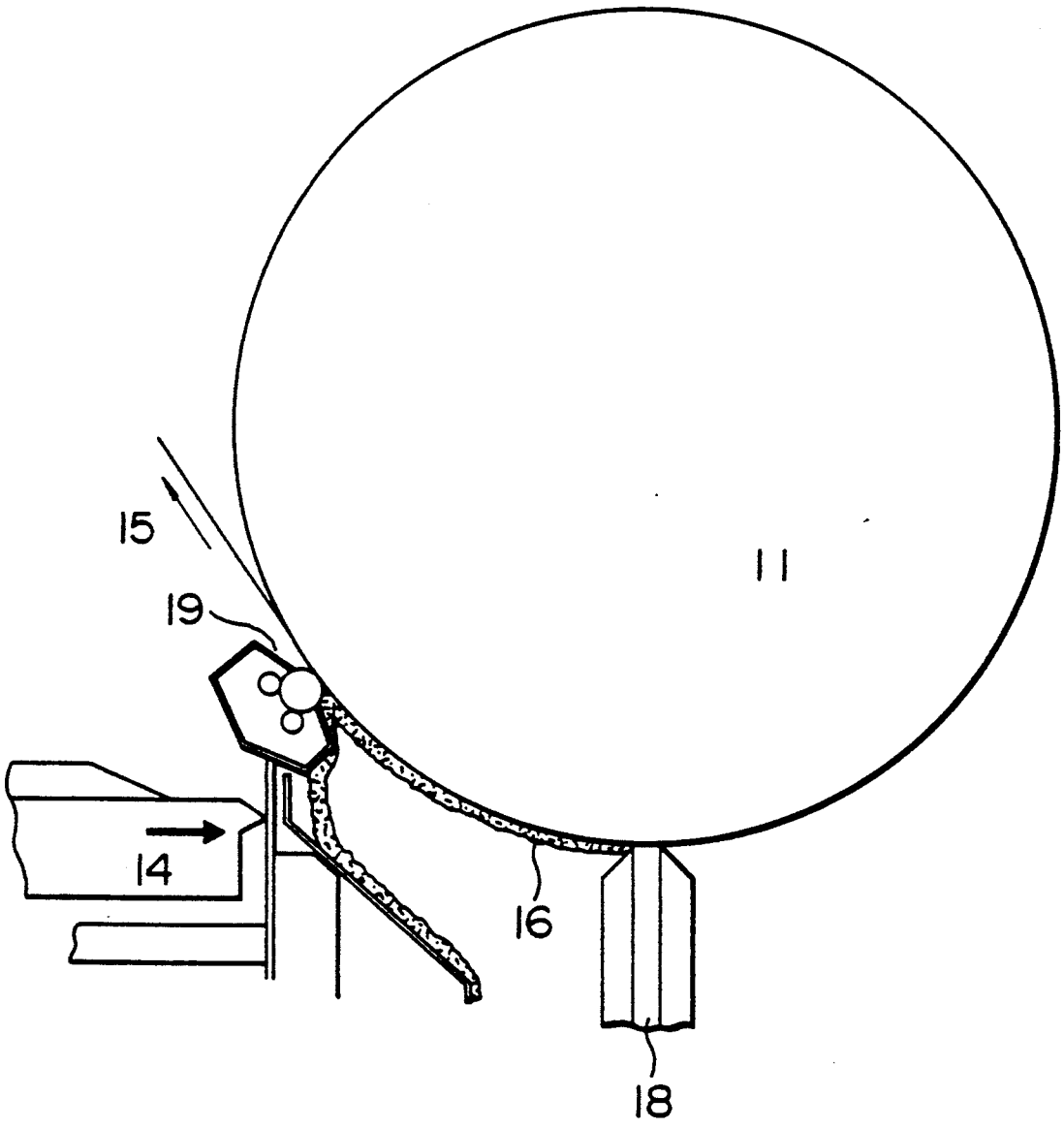
FIG. 3 is a cross-sectional view of a roll blade coater.

The roll blade coating method is also called a bar coating method. Weighing of coating amount and smoothness can be carried out by a rod. It is possible to use three kinds of rods, that is a smooth round rod (a plain roll), a rod wound with wire, and a rod having grooves thereon, depending the purpose. In the present invention, the use of a plain roll is preferable to give an excellent smoothing effect. One example of the roll blade coater is shown in FIG. 3, wherein numeral 11 denotes a backing roll, numeral 14 pressure, numeral 15 paper, numeral 16 a coating color, numeral 18 a fountain applicator and numeral 19 a roll blade.

According to the roll blade coating method, there can be obtained the following advantages over the bent blade coating method disclosed in U.S. Pat. No. 4,414,259. No steaks are generated even if a high concentration coating solution is coated in contrast to the bent blade method wherein no steaks are generated only when a low concentration coating solution is coated. By using the high concentration coating solution, migration of a binder into a lower layer (a support or an undercoating layer) can be reduced. Further, there can be obtained a stable coating layer structure, improvement in surface strength, good profile, improvement in machine matching properties, improvement in resistance to deposition of failing and resistance to sticking, improvement in color developing properties, the coating amount being able to be lowered, lowering in drying load, speed up of the process, lowering in heat fogging, an increase of revolution number of the bar, improvement in image quality, exchange of a blade being unnecessary (a blade should be exchanged in the case of the bent blade coating method due to wear), improvement in operating efficiency, and the like.

Figure 2:
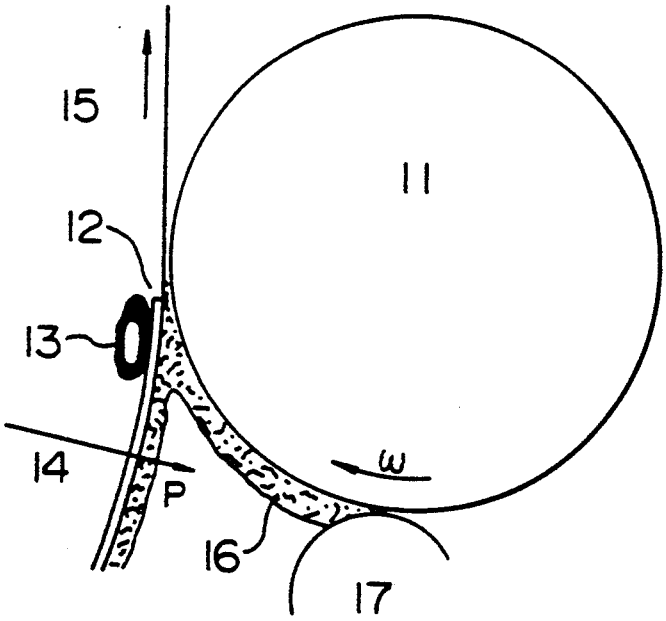
FIG. 2 is a cross-sectional view of a bent blade coater.

One example of a bent blade coater is shown in FIG. 2, wherein numeral 11 denotes a backing roll, numeral 12 a bent blade, numeral 13 a pressure hose, numeral 14 pressure, numeral 15 paper, numeral 16 a coating color, and numeral 17 an applicator roll.

It is very surprising that the advantages mentioned above are obtained by simply changing the bent blade coating method to the roll blade coating method.

A method for coating a coating solution of a color developing composition comprising a color former, a color developer, etc. on a support is explained referring to FIG. 1. In FIG. 1, numeral 1 denotes an unwider for a support, 2 a coater head portion, 3 an applicator, 4 a roll blade coater, 5 a dryer part, 6 a calender part and 7 a winder part for winding up the resulting heat-sensitive recording material. In the coater head portion 2, a distance from a contacting point with the applicator 3 and a contacting point with the roll blade coater 4 is defined as "a dwell length" which is a basis for determining "a dwell time".

In FIG. 1, a support is supplied from the unwinder 1 and passes through a number of rolls for transportation and the applicator 3. From the applicator 3, a coating solution of the color developing composition is supplied and coated on the support. The color developing composition solution permeate the support until a time contacting with the roll blade coater 4 (dwell time). An excess coating solution is removed by the roll blade coater 4. Then, the resulting support passes the dryer part 5 and the calender part 6 to give a heat-sensitive recording material having the color developing layer on the support.

When the dwell time is longer, the coating solution permeates the under layer sufficiently to give a smooth surface and pressure fogging can be prevented in the calender treatment in a later step, but it is not preferable from the viewpoint of operating efficiency. In contrast, when the dwell time is shorter, the operating efficiency is improved, but the permeation of the coating solution into the support is not good, which results in worsening the surface quality (e.g. smoothness) and giving bad images. Therefore, it is preferable to make the dwell time 0.04 to 0.2 seconds. By this, the smoothness and the image quality are improved and the pressure fogging is reduced. In order to make the dwell time 0.04 to 0.2 second, it is preferable to adjust the concentration of the color developing composition solution to 30 to 40% by weight.

As the applicator 3, there can be used a roll applicator, a fountain type applicator, etc. Among them, the use of the fountain type applicator is preferable.

The above-mentioned explanation is made in the case of forming the color developing layer. Such a method can be applied to the case of forming the protective layer on the color developing layer. That is, a coating solution for the protective layer is used in place of the color developing composition solution. In this case, the color developing layer can be formed without using the roll blade coating method mentioned above. That is, the color developing layer is formed by a usual coating method, followed by the formation of the protective layer by the roll blade coating method.

Further, when the protective layer is formed by a two-time coating method, the coating properties are improved compared with the case of one-time coating method and shelf stability such as resistance to plasticizer, etc. is further improved.

As the color former contained in the color developing layer, there can be used so-called leuco dyes including triphenylmethane compounds and fluoran lactone compounds. Examples of the triphenylmethane compounds are 3,3-bis(p-dimethylaminophenyl)-6-dimethylaminophthalide, 3,3-bis(p-dimethylaminophenyl)phthalide, 3-(p-dimethylaminophenyl)-3 (1,2-diaminoindole-3 yl)phthalide, etc. Examples of the fluoran compounds are 2-anilino-3-methyl-6-dimethylaminofluoran, 2-anilino-3-methyl-6-(methylcyclohexylamino)fluoran, 2-anilino-3-methyl-6-(ethylisobenzylamino)fluoran, 2-(p-chloroanilino)-3-methyl-6-diethylaminofluoran, 2-(p-fluoroanilino)-3-methyl-6-diethylaminofluoran, 2-anilino-3-methyl-6-(p-toluidinoethylamino)fluoran, etc. These compounds can be used alone or as a mixture thereof.

As the color developer which reacts with a color former when heated to form a color, there can be used p-octylphenol, p-tert-butylphenol, 1,1-bis(p-hydroxyphenyl)propane, 2,2-bis(p-hydroxyphenyl)propane, 1,1-bis(p-hydroxyphenyl)cyclohexane, 4,4'-thiobisphenol, 4,4'-sulfonyldiphenol, bis(3-allyl-4-hydroxyphenyl)sulfone, novolac type phenol resins, p-hydroxybenzoic acid esters, dimethyl 4-hydroxyphthalate, ethyl 5-hydroxyisophthalate, 3,5-di-tert-butylsalicylic acid and metal salts thereof, 3,5-di-α-methylbenzylsalicylic acid and metal salts thereof, etc.

As a binder for binding and carrying the color former and the color developer, there can be used water-soluble high polymers such as polyvinyl alcohol, carboxymethyl cellulose, hydroxyethyl cellulose, methyl cellulose, carboxy modified polyvinyl alcohol, polyacrylamide, polyacrylic acid, starch and derivatives thereof, caserin, gelatin, alkali salts of styrenemaleic anhydride copolymers, etc., and aqueous emulsions of water-insoluble resins mentioned above.

The solution for forming the color developing layer may further contain one or more sensitivity improving agents, fillers, and other conventionally used additives.

As the sensitivity improving agent, where can be used higher fatty acid amides such as stearamide, etc., benzyl p-benzyloxybenzoate, dibenzyl terephthalate, diphenyl sulfone, 2-benzyloxy naphthalene, etc.

As the filler, there can be used fine powders of inorganic compounds such as calcium carbonate, magnesium carbonate, titanium oxide, zinc oxide, silica, aluminum hydroxide, zinc hydroxide, barium sulfate, clays, talc, surface treated calcium carbonate, silica, etc.; and fine powders of organic materials such as a urea-formaldehyde resin, a polystyrene resin, etc.

As the other additives, there can be used a lubricating agent such as zinc stearate, calcium stearate, various surface active agents, antifoamers, etc., depending on purposes.

As the support for forming the heat-sensitive color developing layer, there can be used paper, synthetic paper, films, etc. Among them, those having excellent smoothness are preferable. If necessary, it is possible to use a support having an undercoating layer thereon obtained by caoting a filler having a large oil absorbing capacity such as calcined kaolin, silica; etc. with a binder such as a styrene-butadiene copolymer latex, starch, polyvinyl alcohol, etc.

The coating amount of the solution for forming the color developing layer on the support is not particularly limited, but in usual, in the range of preferably 0.5 to 15 $g/m^2$, more preferably 3 to 12 $g/m^2$, on dry basis.

The formed color developing layer is subjected to drying and calender treatment by a conventional process such as using a supercalender. In this case, it is necessary to make the surface roughness Ra of the color developing layer 1.1 μm or less and the printing smoothness Rp 7.8 μm or less under a surface pressure of 5 $kg/cm^2$.

When an undercoating layer comprising one or more pigments, binders, and the like is formed between the color developing layer and the support, color developing properties and surface smoothness are preferably improved. Such an undercoating layer can be formed by a conventional method. As the pigments and binders, those mentioned above can be used.

In the case of forming a protection layer on the color developing layer, the following materials can be used as a material for forming the protective layer; cellulose derivatives such as methoxy cellulose, hydroxyethyl cellulose, carboxymethyl cellulose, methyl cellulose, ethyl cellulose, etc.; water-soluble high polymers such as sodium salt of polyacrylic acid, polyvinylpyrrolidone, acrylamide-acrylate copolymers, acrylamide-acrylate-methacrylic acid terpolymers, polyacrylamide derivatives, starches, gelatin, gum arabic, casein, styrene-maleic anhydride copolymer hydrolyzates, styrene-maleic anhydride copolymer half ester hydrolyzates, isobutylene-maleic anhydride copolymer hydrolyzates, polyvinyl alcohol, silica-modified polyvinyl alcohol, carboxy-modified polyvinyl alcohol, sodium polystyrenesulfonate, sodium alginate, etc.; water-insoluble polymers such as styrene-butadiene rubber latex, acrylonitrile-butadiene rubber latex, methyl acrylate-butadiene rubber latex, vinyl acetate emulsion, etc. These polymers can be used alone or as a mixture thereof.

As a waterproofing agent for making a water-soluble high polymer waterproof, there can be used formaldehyde, glyoxal, chrome alum, melamine, a melamineformaldehyde resin, a polyamide resin, a polyamideepichlorohydrin resin, etc.

A solution for forming the protective layer can be prepared by using the above-mentioned materials in proper concentrations (preferably 5 to 40% by weight in solid content) and proper viscosities (preferably 50 to 500 cps). When a waterproofing agent is contained, preferable solid content is 5 to 30% by weight based on the weight of the coating solution for protective layer.

In the case of coating the protective layer, the color developing layer is first formed on a support in an amount of preferably 0.5 to 15 g/m$^2$, more preferably 3to 12 g/m$^2$, on dry basis, by a conventional coating method, and then the protective layer is formed by using an applicator, and by removing an excess solution for protective layer by a roll blade coating method, followed by drying and calendering to make the surface roughness Ra 1.1 μm or less.

By forming the protective layer, there can be obtained a heat-sensitive recording material having a uniform and stable coating structure particularly excellent in smoothness as well as excellent in shelf stability, color developing properties and recording machine applicability.

If required, a backcoat layer can be formed on one side of the support opposite to the color developing layer or the protective layer. The formation of the backcoat layer is particularly effective for using the heat-sensitive recording material of the present invention as labels, particularly releasable labels, since the backcoat layer can prevent the heat-sensitive recording material from undesirable influences of plasticizers present in a sheet to be labelled or undesirable sticking due to static charge in a vending machine having an automatic paper supplying mechanism.

As a material for forming the backcoat layer, there can be used the same water-soluble high polymers and water-insoluble polymers as used for forming the protective layer mentioned above. Further the backcoat layer may contain one or more pigments such as colloidal silica, etc., and waxy materials.

The backcoat layer can be formed by a conventional coating method using, for example, an air knife, a blade, a roll blade, or the like, in a conventional amount.

The backcoat layer can be formed before the formation of the undercoating layer or the color developing layer, or after the formation of the color developing layer or the protective layer, or at any time during the formation of the heat-sensitive recording material.

This invention is illustrated by way of the following Examples, in which all parts and percents are by weight unless otherwise specified.

EXAMPLE 1

Liquid A, Liquid B and Liquid C were prepared by sand milling mixtures having the following compositions for dispersion so as to have average particle sizes of 2 μm or less:

| | | |
|---|---|---|
| (A) | 2-Anilino-3-methyl-6-diethylaminofluoran | 10 parts |
| | 10% Hydroxyethyl cellulose aqueous solution | 5 parts |
| | Water | 15 parts |
| (B) | Bisphenol A | 20 parts |
| | 10% Polyvinyl alcohol aqueous solution | 20 parts |
| | Water | 23 parts |
| (C) | Zinc stearate | 10 parts |
| | Calcium carbonate | 40 parts |
| | 5% Methyl cellulose aqueous solution | 50 parts |
| | Water | 17 parts |

A heat-sensitive color developing coating solution was prepared by mixing 6 parts of Liquid A, 20 parts of Liquid B, 20 parts of Liquid C, 30 parts of 35% acrylic water-soluble binder and 25 parts of 20% stearamide emulsion (HYDRIN M-7, a trade name, mfd. by Chukyo Yushi Co., Ltd.) with stirring. The coating solution had a solid content of 33% and a viscosity of 280 cps.

On the other hand, an undercoating layer was formed on fine paper having a basis weight of 50 g/m$^2$ by coating a solution comprising 100 parts of calcined kaolin and 10 parts of styrene-butadiene latex in an amount of 8 g/m$^2$ on dry basis. The above-mentioned coating solution was coated on the undercoating layer by a roll blade coating method (a plain roll with 10 mm in diameter, 300 r.p.m.) at a coating rate of 500 m/min (dwell time 0.08 second) in an amount of 5 g/m$^2$ (on dry basis), followed by drying. The resulting color developing layer had a surface roughness Ra of 0.86 μm, a printing smoothness Rp of 7.69 μm under a surface pressure of 5 kg/cm$^2$, and a Bekk surface smoothness of 200 seconds.

When the resulting heat-sensitive recording material was printed using a facsimile machine (PANAFAX UF-7, a trade name mfd. by Matsushita Graphic Communication Systems, Inc.), the obtained printing density (D) was 1.24. Further, no sticking was admitted.

EXAMPLE 2

The heat-sensitive recording material obtained in Example 1 was subjected to a slight calender treatment at a linear pressure of 40 kg/cm to give a heat-sensitive recording material having a Bekk surface smoothness of 400 seconds. The resulting color developing layer had a surface roughness Ra of 0.64 μm and a printing smoothness Rp of 4.91 μm under a surface pressure of 5 kg/cm$^2$. Pressure fogging was hardly admitted.

When the resulting heat-sensitive recording material was printed using the same facsimile machine as used in Example 1, the obtained printing density (D) was 1.29. Further, no sticking was admitted.

COMPARATIVE EXAMPLE 1

To the same coating solution as obtained in Example 1, water was added to give a coating solution having a concentration of 18% and a viscosity of 100 cps.

The coating solution was coated on the same undercoating layer formed on fine paper as used in Example 1 using an air knife coater at a rate of 200 m/min in an amount of 5 g/m$^2$ (on dry basis), followed by drying. The resulting color developing layer (not subjected to a calender treatment) had a surface roughness Ra of 1.38 μm, a printing smoothness Rp of 17.63 μm under a surface pressure of 5 kg/cm$^2$, and a Bekk surface smoothness of 100 seconds.

When the resulting heat-sensitive recording material was printed using the same facsimile machine as used in Example 1, the obtained printing density (D) was 1.01. There was admitted printing unevenness presumably due to absorption unevenness of the coating solution on the printing portions. At the same time, sticking was also admitted.

COMPARATIVE EXAMPLE 2

The heat-sensitive recording material obtained in Comparative Example 1 was subjected to a calender treatment to give a heat-sensitive recording material having a Bekk surface smoothness of 420 seconds. The color developing layer of the resulting heat-sensitive recording material had a surface roughness Ra of 0.74 μm and a printing smoothness Rp of 5.23 μm under a pressure of 5 kg/cm$^2$. At the same time, remarkable pressure fogging was admitted.

When the resulting heat-sensitive recording material was printed using the same facsimile machine as used in Example 1, the obtained printing density (D) was 1.24. There was admitted printing unevenness presumably due to absorption unevenness of the coating solution on the printing portions. At the same time, sticking was also admitted.

EXAMPLE 3

Formation of Color Developing Layer

Liquid A, Liquid B and Liquid C were prepared by sand milling mixtures having the following compositions for dispersion so as to have average particle sizes of 2 μm or less.

| | | |
|---|---|---|
| (A) | 2-Anilino-3-methyl-6-diethyl-aminofluoran | 10 parts |
| | 10% Hydroxyethyl cellulose aqueous solution | 5 parts |
| | Water | 15 parts |
| (B) | Bis(3-allyl-4-hydroxyphenyl)-sulfone | 25 parts |
| | 1,1,3-Tris(3-tert-butyl-4-hydroxy-6-methylphenyl)butane | 10 parts |
| | 10% Polyvinyl alcohol aqueous solution | 20 parts |
| | Water | 45 parts |
| (C) | Zinc stearate | 10 parts |
| | Calcium carbonate | 40 parts |
| | 5% Methyl cellulose aqueous solution | 50 parts |
| | Water | 50 parts |

A heat-sensitive color developing coating solution was prepared by mixing 6 parts of Liquid A, 20 parts of Liquid B, 30 parts of Liquid C, 70 parts of a 10% polyvinyl alcohol aqueous solution, and 25 parts of a 20% stearamide emulsion HYDRIN M7, a trade name, mfd. by Chukyo Yushi Co., Ltd. with stirring. The coating solution had a solid content of 21% and a viscosity of 50 cps. The coating solution was coated on fine paper having a basis weight of 60 g/m$^2$ in an amount of 6 g/m$^2$ on dry basis using an air knife coater, followed by drying to give a heat-sensitive color developing layer.

Formation of Protective Layer

A solution for forming a protective layer was prepared by adding an amine series waterproofing agent to a liquid containing as an effective component a graft copolymer emulsion obtained by polymerizing methyl methacrylate, a lower hydroxyalkyl acrylate and methacrylic acid in a polyvinyl alcohol aqueous solution with a dispersant so as to have a solid content of 20% and a viscosity of 300 cps. The resulting solution was coated on the color developing layer obtained above by a roll blade coating method (a plain roll with 10 mm in diameter, 140 r.p.m.) at a coating rate of 300 m/min (dwell time 0.14 second) in an amount of 4 g/m$^2$ on dry basis, followed by drying. The resulting protective layer had a surface roughness Ra of 1.06 μm and a Bekk surface smoothness of 300 seconds. The resulting heat-sensitive recording material was subjected to a calender treatment so as to make the Bekk surface smoothness of the protective layer 500 to 600 seconds.

The shelf stability and color developing properties were tested and shown in Table 1.

EXAMPLE 4

The same solution for forming a protective layer as obtained in Example 3 was coated on the same color developing layer as in Example 3 by the same roll blade coating method as in Example 3 at a rate of 300 m/min twice so as to make the total coating amount 3 g/m$^2$ after dried. The resulting protective layer had a surface roughness Ra of 0.98 μm and a Bekk surface smoothness of 280 seconds. The resulting heat-sensitive recording material was subjected to a calender treatment so as to make the Bekk surface smoothness of the protective layer 500 to 600 seconds.

The shelf stability and color developing properties were tested and shown in Table 1.

COMPARATIVE EXAMPLE 3

The solution for forming a protective layer obtained in Example 3 was coated on a color developing layer in the same manner as described in Example 3 except for using a tip type blade coater at a coating rate of 300 m/min in an amount of 4 g/m$^2$ after dried. The resulting protective layer had a surface roughness Ra of 1.12 μm and a Bekk surface smoothness of 120 seconds, but undesirably generated a number of streaks on the coated surface. The resulting heat-sensitive recording material was subjected to a calender treatment so as to make the Bekk surface smoothness of the protective layer 500 to 600 seconds.

The shelf stability and color developing properties were tested and shown in Table 1.

COMPARATIVE EXAMPLE 4

The solution for forming a protective layer obtained in Example 3 was diluted with water so as to make the solid content 16% and the viscosity 230 cps.

The resulting solution was coated on the same color developing layer as obtained in Example 3 by an air knife coating method at a coating rate of 200 m/min in an amount of 4 g/m$^2$ after dried. The resulting protective layer had a surface roughness Ra of 1.14 μm and a Bekk surface smoothness of 160 seconds, but generated a number of coating unevenness presumably due to absorption unevenness of the solution on the coated surface. The resulting heat-sensitive recording material was subjected to a calendar treatment so as to make the Bekk surface smoothness of the protective layer 500 to 600 seconds.

The shelf stability and color developing properties were tested and shown in Table 1.

TABLE 1

| | Example | | Comparative Example | |
|---|---|---|---|---|
| Example No. | 3 | 4 | 3 | 4 |
| Printing density *1 | 1.24 | 1.25 | 1.10 | 1.05 |

TABLE 1-continued

| Example No. | Example 3 | Example 4 | Comparative Example 3 | Comparative Example 4 |
|---|---|---|---|---|
| Resistance to plasticizer *2 | | | | |
| Before treatment | 1.41 | 1.43 | 1.38 | 1.37 |
| After treatment | 1.02 (72%) | 1.30 (91%) | 0.91 (66%) | 0.57 (42%) |
| Sticking *3 | ∘ | ∘ | Δ~x | x |
| Fogging *4 | ∘ | ∘ | x | x |

Note)
*1: Printing density
Tester: Printing tester MF-1 mfd. by Matsushita Electronic Components Co., Ltd.
Printing conditions:
Thin film type line head (resistance value 300 Ω), potential 16 V, pressure 1.7 kg/148 cm wide, current passing time 2.5 ms. Printing densities were compared by measuring optical densities using Macbeth RD 514 densitometer.
*2: Resistance to plasticizer
Printer: Label printer Ishida Degital Scale 805P mfd. by Ishida Scale Mfg. Co., Ltd.
Printing conditions:
Potential 22.9 V, resistance value 320 Ω, current passing time 2.2 ms.
Test method:
Printed portions were contacted with a wrapping film made from polyvinyl chloride, pressed and allowed to stand at 40° C. for 40 hours to observe the density and retention rate of the printed portions before and after the contact.
*3: Sticking
Test method:
Printing was conducted using the printing tester MF-1 while changing pulse width and sticking was evaluated by the degree of sound of sticking: ∘ good, Δ slightly bad, x bad.
*4: Fogging
The degree of fogging on the treated surface was observed by the naked eye and judged: ∘ no fogging, Δ slight fogging, x remarkable fogging.

COMPARATIVE EXAMPLE 5

The process of Example 1 was repeated except for using a bent blade coater in place of a roll blade coater. The resulting color developing layer exhibited a large number of streaks so as to make it impossible to use practically.

COMPARATIVE EXAMPLE 6

The process of Example 3 was repeated except for using a bent blade coater in place of a roll blade coater. The resulting protective layer exhibited a large number of streaks so as to make it impossible to use practically.

As is clear from the above-mentioned Examples, the heat-sensitive recording materials obtained by the process of the present invention have uniform and smooth color developing layer or protective layer, so that excellent dynamic sensitivity can be obtained even by a slight calender treatment. Further the heat-sensitive recording materials obtained in the present invention are well-balanced in quality and excellent in recording machine applicability without bringing about streaks, pressure fogging and heat fogging. Moreover, by having a uniform and smooth protective layer, the coating properties are improved and the self stability is also improved.

What is claimed is:

1. A process for producing a heat-sensitive recording material comprising a support and formed thereon a color developing layer having a surface roughness Ra of 1.1 μm or less and a printing smoothness Rp of 7.8 μm or less under a pressure of 5 kg/cm$^2$, which comprises coating a color developing composition solution comprising a color former and a color developer on a support using an applicator, removing an excess color developing composition solution by a roll blade coating method, and drying the resulting support.

2. A process according to claim 1, which further comprises a step of calender treatment after drying.

3. A process according to claim 1, which further comprises forming an undercoating layer comprising ore or more pigments and a binder on the support before coating the color developing composition solution.

4. A process according to claim 1, which further comprises forming a backcoat layer on a side of the support opposite to the color developing layer before or after the formation of the color developing layer.

5. A process according to claim 3, which further comprises forming a backcoat layer on a side of the support opposite to the color developing layer before or after the formation of the color developing layer.

6. A process for producing a heat-sensitive recording material comprising a support, formed thereon a color developing layer, and formed thereon a protective layer having a surface roughness Ra of 1.1 μm or less, which comprises forming a color developing layer comprising a color former and a color developer on a support, coating a coating solution for protective layer on the color developing layer using an applicator, removing an excess coating solution for protective layer by a roll blade coating method, and drying the resulting support.

7. A process according to claim 6, which further comprises a step of calender treatment after drying.

8. A process according to claim 6, which further comprises forming an undercoating layer comprising one or more pigments and a binder on the support before forming the color developing layer.

9. A process according to claim 6, which further comprises forming a backcoat layer on a side of the support opposite to the protective layer before or after the formation of the protective layer.

10. A process according to claim 8, which further comprises forming a backcoat layer on a side of the support opposite to the protective layer before or after the formation of the protective layer.

11. A process according to claim 1, wherein the roll blade coating method is controlled by a dwell time of 0.04 to 0.2 second.

12. A process according to claim 6, wherein the roll blade coating method is controlled by a dwell time of 0.04 to 0.2 second.

* * * * *